US012473173B2

(12) United States Patent
Russell, III et al.

(10) Patent No.: US 12,473,173 B2
(45) Date of Patent: Nov. 18, 2025

(54) INTERCHANGEABLE CABLE MANAGEMENT SYSTEM

(71) Applicant: Purdue Research Foundation, West Lafayette, IN (US)

(72) Inventors: Carl R. Russell, III, San Ramon, CA (US); Josephine R. Schlosser, Wheaton, IL (US); Emily J. Linder, Fort Wayne, IN (US); Maya A Godbole, Carmel, IN (US); Trevor M. Sheehan, Zionsville, IN (US); Ella I. McCoy, Otisco, IN (US); Fearghal Keenan, Scotstown (IE)

(73) Assignee: Purdue Research Foundation, West Lafayette, IN (US)

( * ) Notice: Subject to any disclaimer, the term of this patent is extended or adjusted under 35 U.S.C. 154(b) by 184 days.

(21) Appl. No.: 18/427,689

(22) Filed: Jan. 30, 2024

(65) Prior Publication Data

US 2024/0262652 A1 Aug. 8, 2024

Related U.S. Application Data

(60) Provisional application No. 63/443,154, filed on Feb. 3, 2023.

(51) Int. Cl.
*B65H 75/44* (2006.01)
*B65H 75/48* (2006.01)

(52) U.S. Cl.
CPC ..... *B65H 75/4431* (2013.01); *B65H 75/4471* (2013.01); *B65H 75/486* (2013.01); *B65H 2701/34* (2013.01)

(58) Field of Classification Search
CPC .. B65H 75/44; B65H 75/486; B65H 75/4431; B65H 75/4471; B65H 2701/34
See application file for complete search history.

(56) References Cited

U.S. PATENT DOCUMENTS 5,173,067 A * 12/1992 Biba ..... B65H 75/4431 242/379.2
8,774,443 B1 * 7/2014 Anderson ..... H04R 1/1033 381/375
2023/0073654 A1 * 3/2023 Queener ..... B65H 75/4431

OTHER PUBLICATIONS

ULINE Product Literature for Retractable Cord Reel—All Purpose, 25' (Model No. H-5642). Retrieved from https://web.archive.org/web/20211028143752/https://www.uline.com/Product/Detail/H-5652/Extension-Cords-and-Power-strips/Retractable . . . (Oct. 28, 2021).

(Continued)

*Primary Examiner* — Sang K Kim
(74) *Attorney, Agent, or Firm* — Purdue Research Foundation

(57) ABSTRACT

A cable management apparatus includes a housing, an axle, a rotary member, and a gear member. The housing includes a front face and a rear face, the front face including a first opening. The axle is positioned within the housing and defines a longitudinal axis. The rotary member is positioned within the first opening and defines a bore shaped to receive a cable therethrough. The gear member provides a rotatable coupling between the rotary member, the housing, and the axle. The gear member further includes a first bearing and a second bearing. The first bearing provides a rotatable coupling between the rotary member and the axle, and the second bearing provides a rotatable coupling between the rotary member and the housing.

20 Claims, 16 Drawing Sheets

(56) References Cited

OTHER PUBLICATIONS

SITAKE Product Literature posted on Amazon for Sitake 4PCS Cable Management, Retractable Portable Cord Organizer, 4 Colors, Roud Flexible Cable Organizer for Home office Classroom, (Apr. 29, 2021).

* cited by examiner

INTERCHANGEABLE CABLE MANAGEMENT SYSTEM

CROSS-REFERENCE TO RELATED APPLICATIONS

This application is related to and claims the priority benefit of U.S. Provisional Patent Application No. 63/443,154, entitled "Interchangeable Cable Management System," filed Feb. 3, 2023, the contents of which are hereby incorporated by reference in their entirety into the present disclosure.

TECHNICAL FIELD

The present application relates to a cable management system and, more particularly, the present application provides an interchangeable cable storage system for selectively extending and retracting cables.

BACKGROUND

This section introduces aspects that may help facilitate a better understanding of the disclosure. Accordingly, these statements are to be read in this light and are not to be understood as admissions about what is or is not prior art.

Healthcare professionals often face tangled and damaged cables when taking a patient's vitals while using machines affixed to rolling carts. This has become a widespread problem in the industry which not only wastes valuable time but also comes at a monetary cost for healthcare institutions to replace the cables. Thus, improvements in cable management systems are needed. While the healthcare industry, and more particularly vitals machine power cables and the like, are described in detail herein, it should be understood that the cable management system described is applicable to a wider range of cable systems.

SUMMARY

The present disclosure describes a cable management apparatus that includes aspects which can selectively provide extension, retraction, and storage of various cables. In some aspects, the apparatus can include a housing, an axle, a rotary member, and a gear member. The housing can include a front face and a rear face, and the front face can include a first opening. The axle can be positioned within the housing and can define a longitudinal axis. The rotary member can be positioned within the first opening and can define a bore. The bore can be shaped to receive a cable therethrough. The gear member can be configured to provide a rotatable coupling between the rotary member, the housing, and the axle.

In some aspects, the first bearing can be configured to provide a rotatable coupling between the rotary member and the axle. The rotary member can be operable to rotate about the longitudinal axis relative to the axle. In other aspects, the second bearing can be configured to provide a rotatable coupling between the rotary member and the housing. The rotary member can be operable to rotate about the longitudinal axis relative to the housing. A rotation of the rotary member about the longitudinal axis relative to the axle can be operable to wrap the cable around a portion of the axle.

In some aspects, the rear face of the housing can include a second opening shaped to receive the cable therethrough. In other aspects, the first opening of the housing can define a groove. A portion of the rotary member can be configured to translate through the groove when the rotary member rotates about the longitudinal axis relative to the housing.

In additional aspects, the apparatus can include a rotor spring having a first end and a second end, with the first end configured to couple with the rotary member and the second end configured to couple with the axle. As such, a rotation of the rotary member relative to the axle increases or decreases a tension defined by the rotor spring. The apparatus can further include a locking mechanism to selectively restrict rotation of the rotary member. To that end, an exterior surface of the rotary member can include a gear having a plurality of gear teeth, and the apparatus can include a locking lever extending through a surface of the housing from an exterior position relative to the housing to a position within the inner cavity of the housing adjacent to one or more of the plurality of gear teeth of the rotary member. The locking lever can be selectively operable to engage and disengage the gear.

This summary is provided to introduce a selection of the concepts that are described in further detail in the detailed description and drawings contained herein. This summary is not intended to identify any primary or essential features of the claimed subject matter. Some or all of the described features may be present in the corresponding independent or dependent claims, but should not be construed to be a limitation unless expressly recited in a particular claim. Each embodiment described herein does not necessarily address every object described herein, and each embodiment does not necessarily include each feature described. Other forms, embodiments, objects, advantages, benefits, features, and aspects of the present disclosure will become apparent to one of skill in the art from the detailed description and drawings contained herein. Moreover, the various apparatuses and methods described in this summary section, as well as elsewhere in this application, can be expressed as a large number of different combinations and subcombinations. All such useful, novel, and inventive combinations and subcombinations are contemplated herein, it being recognized that the explicit expression of each of these combinations is unnecessary.

BRIEF DESCRIPTION OF THE DRAWINGS

While the specification concludes with claims which particularly point out and distinctly claim this technology, it is believed this technology will be better understood from the following description of certain examples taken in conjunction with the accompanying drawings, in which like reference numerals identify the same elements and in which:

Figure 1:
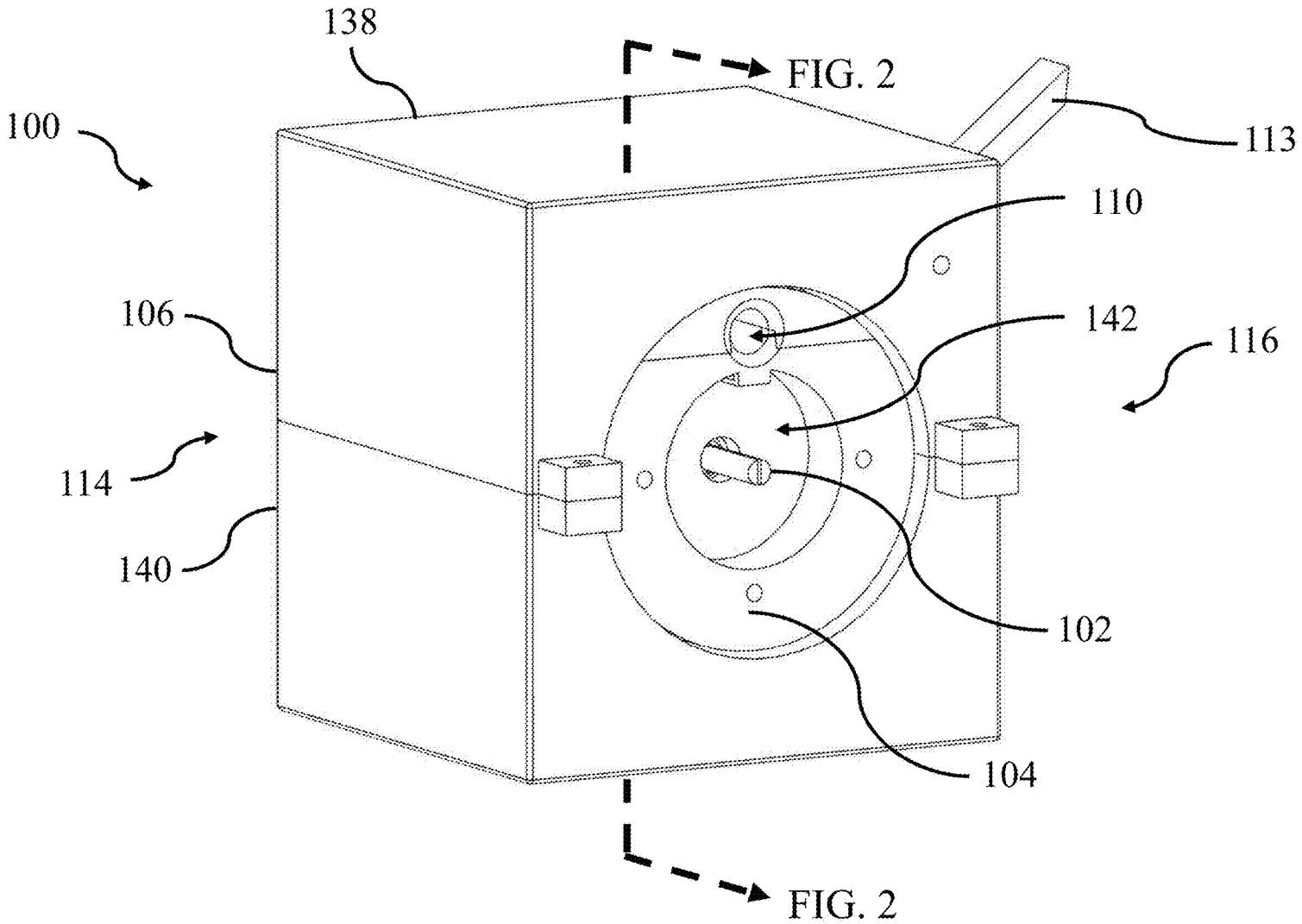
FIG. 1 depicts a front isometric view of one exemplary cable management system, showing the system housed within a protective enclosure having a top portion and a bottom portion, showing the spring cover removed.

The drawings are not intended to be limiting in any way, and it is contemplated that various embodiments of the technology may be carried out in a variety of other ways, including those not necessarily depicted in the drawings. The accompanying drawings incorporated in and forming a part of the specification illustrate several aspects of the present technology, and together with the description serve to explain the principles of the technology; it being understood, however, that this technology is not limited to the precise arrangements shown, or the precise experimental arrangements used to arrive at the various graphical results shown in the drawings.

DETAILED DESCRIPTION

The following description of certain examples of the technology should not be used to limit its scope. Other examples, features, aspects, embodiments, and advantages of the technology will become apparent to those skilled in the art from the following description, which is by way of illustration, one of the best modes contemplated for carrying out the technology. As will be realized, the technology described herein is capable of other different and obvious aspects, all without departing from the technology. Accordingly, the drawings and descriptions should be regarded as illustrative in nature and not restrictive.

It is further understood that any one or more of the teachings, expressions, embodiments, examples, etc. described herein may be combined with any one or more of the other teachings, expressions, embodiments, examples, etc. that are described herein. The following-described teachings, expressions, embodiments, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

Cables (e.g., power cables, data cables, medical wiring, pneumatic tubes, etc.) that are unsecured or freely hanging within clinical settings are susceptible to damage. In one example, cables associated with rolling vitals machine carts can end up contacting the floor, furniture, humans, or other items nearby as the stands are moved around a patient's room. Cable damage results in increased costs of replacing cables and making other repairs to the equipment they are attached to or come into contact with. In addition, technicians and nurses face inconveniences when interacting with existing systems as time is spent untangling cables when trying to place them in the cart. This time could be better utilized interacting with patients if the system efficiently held and stored cables while protecting them from damage. Further, existing independent cable systems for clinical settings are unable to be interchangeable between different cable types, and further are incapable of providing selective extension and retraction as described herein.

Particularly, the interchangeable, retractable cable management system described herein can accommodate different, interchangeable types of cables will allow for safe storage of the cable(s) while allowing them to be accessed and transported safely and easily. The cables may be selectively extended by a user pulling on them and engaging a locking mechanism or brake, and selectively retracted by the user disengaging the locking mechanism or brake. This system allows the cables to be stored away quickly, safely, and easily when the machine is not in use, keeping the cables secure and tangle free.

Figure 2:
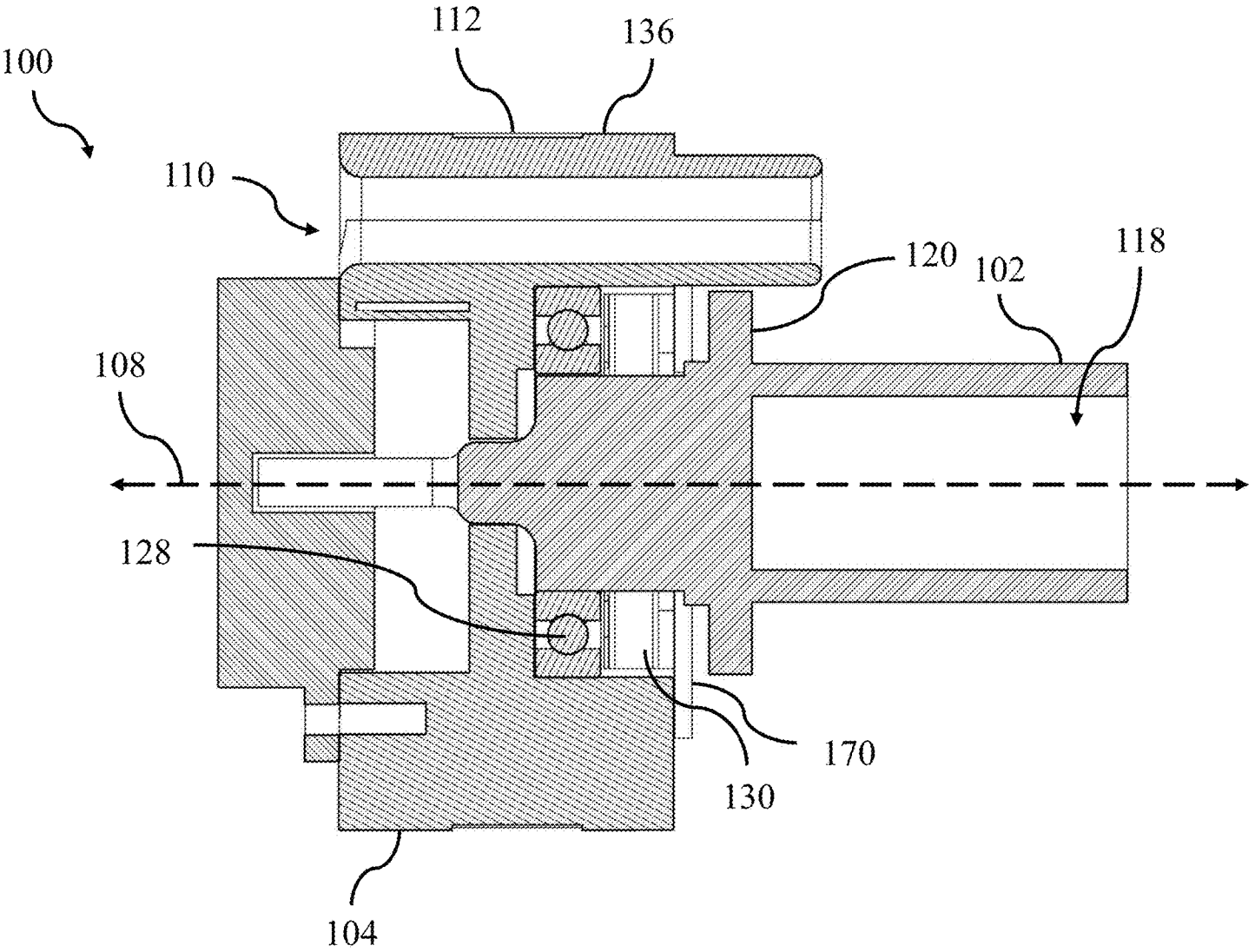
FIG. 2 depicts a cross-section view of the cable management system of FIG. 1 taken across cutting plane FIG. 2-FIG. 2 of FIG. 1, showing the protective enclosure, spring, and spring cover removed.
Figure 3:
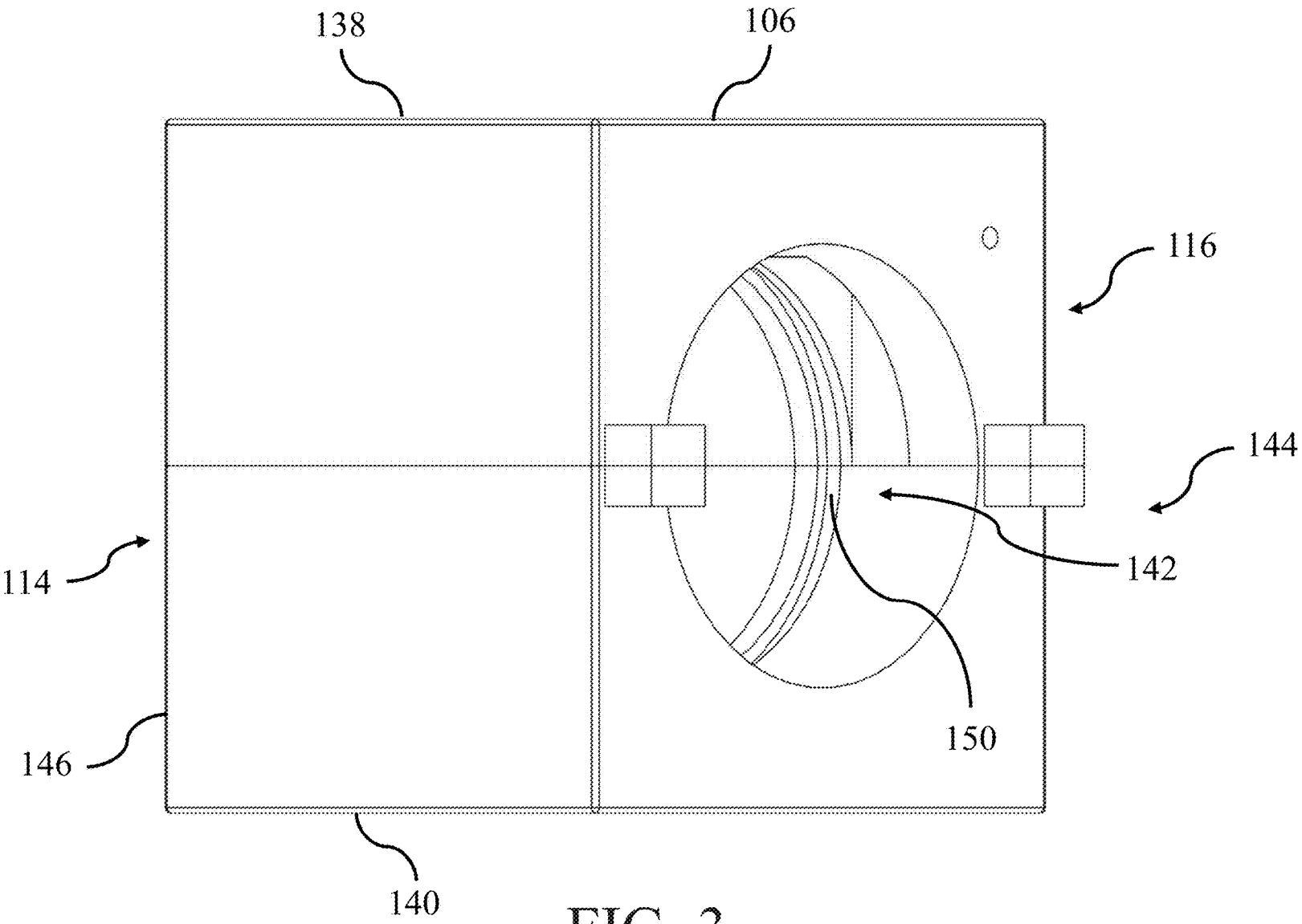
FIG. 3 depicts a front isometric view of the protective enclosure, showing the top portion coupled with the bottom portion.

As shown in FIGS. 1-3, one exemplary cable management system (100) generally includes an axle (102) and a rotary member (104) housed within a protective enclosure (106), the rotary member (104) being operable to axially rotate with respect to the central axis (108) defined by the axle (102) (see, FIG. 2). Specifically, the axle (102) and rotary member (104) are configured to wrap one or more cables (see, FIGS. 11-12) around the axle (102) in a safe and organized fashion.

More particularly, the opening (110) allows for the cable to pass through the rotary member (104) and wind internally around an axle (102). The proximal end of the cable enters the opening (110) of the rotary member (104), and the distal end of the cable exits out of the rear opening (148) through the back side of the enclosure (106) (see, FIGS. 4A and 4B).

This system (100) is most applicable for cables that have attachment members (e.g., data or power transfer plugs) at both ends. For example, for a vitals machine, one end of the cable couples with the vitals monitor while the other end may have a measurement device on it, such as a pulse oximeter or blood pressure cuff. The cable end that couples with the vitals monitor may be oriented at the rear end (114) of the enclosure (106) and the other end with the measurement device may be oriented at the front end (116) of the enclosure (106).

As shown in FIG. 2, the rightmost section is the hollow portion (118) of the cylindrical axle (102). The cable wraps around the axle (102) at the hollow portion (118). Further, the axle (102) may be tiered and extend throughout the entire internal system. The axle (102) includes a flange or barrier (120) to prevent the cable from winding into the rotary member (104). The rotary member (104) surrounds the axle tiers (122, 124). This rotary member (104) can be seen when looking at the front view of the enclosure (106).

Surrounding the axle (102) is a gear member (126) that is shaped and configured to couple with the rotary member (104) to allow the rotary member (104) to axially rotate about the axis (108) but without rotating the axle (102). Particularly, a first bearing member (128) is positioned centrally on the gear member (126) and forms an axially rotatable connection between the rotary member (104) and the axle (102). A four-bearing set (130, 132, 134, 135) further functions to allow the rotary member (104) to axially rotate within the enclosure (106) (see, FIG. 12). The cable fastener (136) holds the cable underneath it and within the opening (110) of the rotary member (104). In the following paragraphs, various individual portions of the system (100) will be described in greater detail.

As shown in FIG. 3, the enclosure (106) includes a first (top) half (138) and a second (bottom) half (140) that may be affixed together to form the complete encasement. The circular opening (142) on the front face (144) of the enclosure (106) extends into the system (100) to house the rotary member (104). Grooves (150) line the interior edge of the circular opening (142) and act as a track for the four-bearing set (130, 132, 134, 135) of the gear member (126). On the back face (146) of the enclosure (106) is an opening (148) formed by both the top half (138) and the bottom half (140) of the enclosure (106). In alternative embodiments, the opening (148) may instead be formed entirely on either the top half (138) or the bottom half (140) of the enclosure (106).

To change out the cable, the enclosure (106) may be separated into the two halves (138, 140) to expose the axle (102) and cable therein. The user then removes the axle (102) from the enclosure (106). Next, the cable fastener (136) can be removed or hinged open via a hinged coupling to release the cable from the opening (110). This will allow access to the cable where it can be unwound from the axle (102) and removed from the enclosure (106). A replacement cable can then be inserted by feeding it through the opening (148) on back of the enclosure (106) (see, FIG. 17), winding it around the axle (102) and out the front opening (110), and replacing the cable fastener (136) onto the rotary member (104).

Figure 4A:
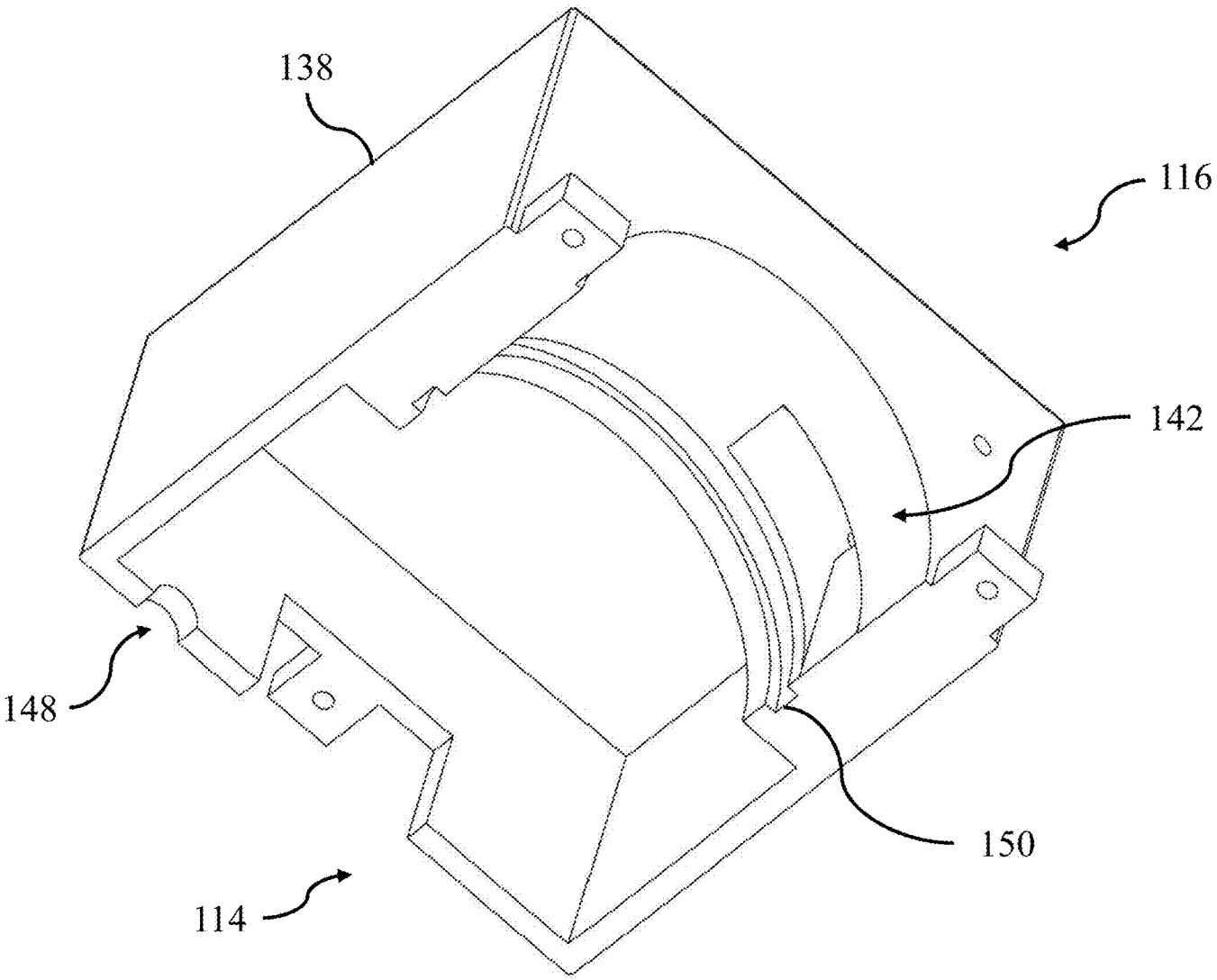
FIG. 4A depicts a front isometric view of the protective enclosure, showing the bottom half removed.
Figure 4B:
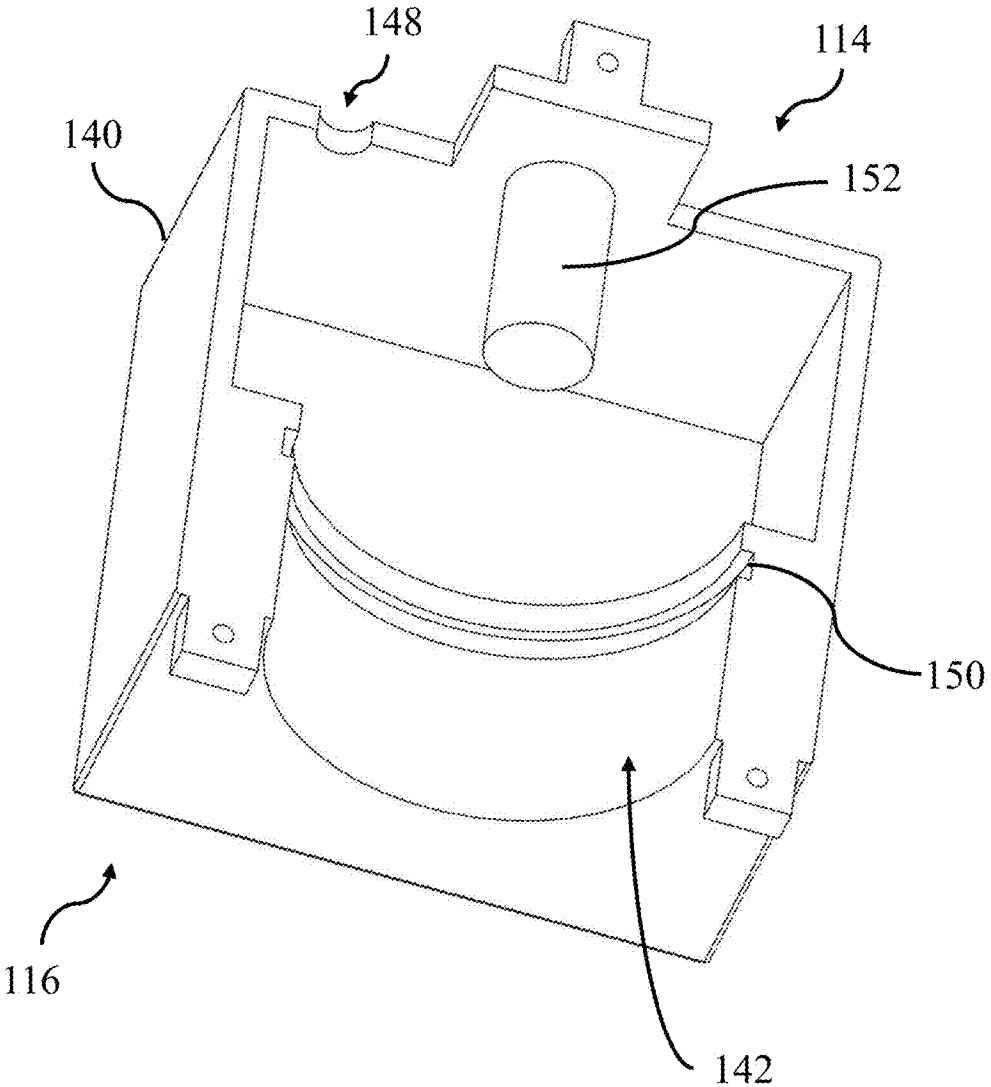
FIG. 4B depicts a front isometric view of the protective enclosure, showing the top half removed.

FIG. 4A shows the top half (138) of the enclosure (106). As described above, the rotary member (104) is oriented near the right side with the four-bearing set (130, 132, 134, 135) of the gear member (126) fitting in the grooves (150) of the circular opening (142). The enclosure (106) further includes a cylindrical extension (152) that fits within the hollow portion (118) of the axle (102) to hold the axle (102) securely into place relative to the enclosure (106). FIG. 4B shows the bottom half (140) of the enclosure (106). In some embodiments, the cylindrical extension (152) extends entirely from one half (e.g., either the top half (138) or the bottom half (140), shown in FIG. 4B extending from the bottom half (140), or is alternative embodiments the cylindrical extension (152) may be split between the top half (138) and the bottom half (140) and thereby formed as the top half (138) and bottom half (140) are joined.

Figure 5:
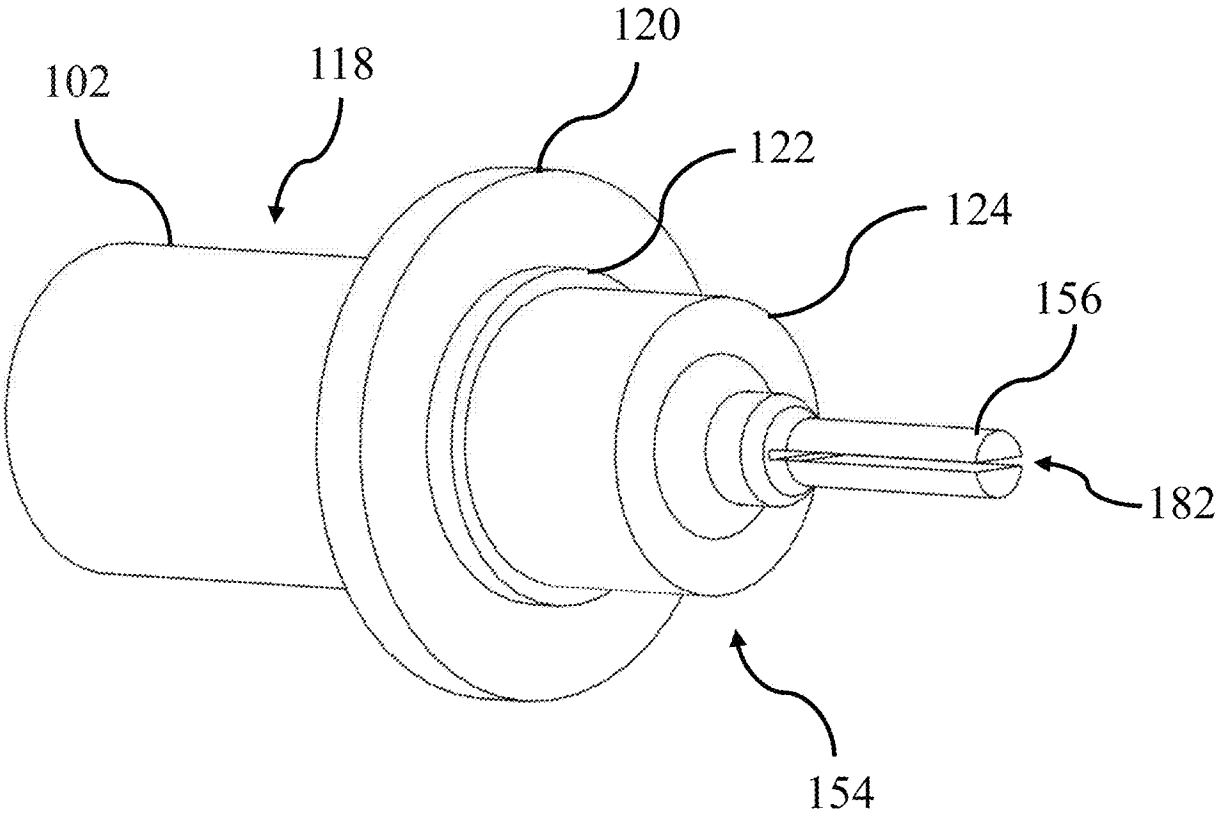
FIG. 5 depicts a front isometric view of the axle of the cable management system of FIG. 1, shown with all other portions of the cable management system removed.

FIG. 5 shows the axle (102). The hollow portion (118) of the axle (102) is configured to fit over the extension (152) at the back of the enclosure (106). The cable wraps around this hollow portion (118) of the axle (102). The first tier (120) prevents the cable from wrapping onto the front portion (154) of the axle (102). The next two tiers (122, 124) allow for the rotary member (104) and the first bearing member (128) to function as described.

Figure 7:
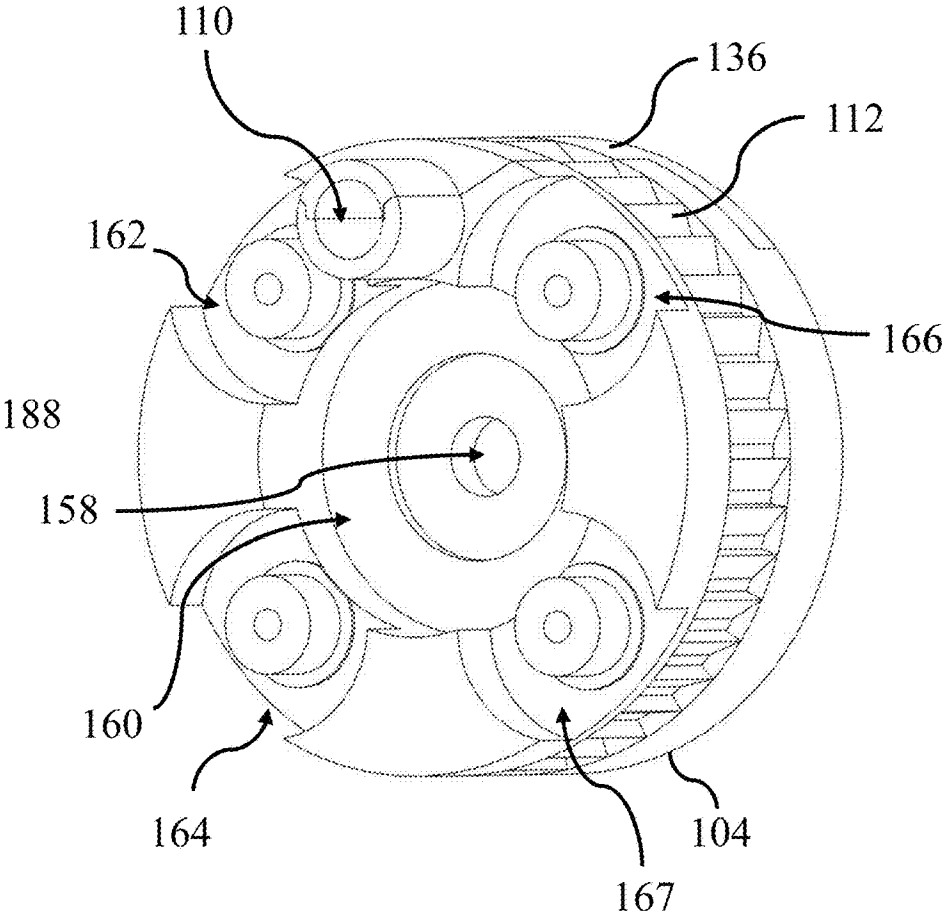
FIG. 7 depicts a rear isometric view of the rotary wheel and cable fastener of FIG. 6.
Figure 6:
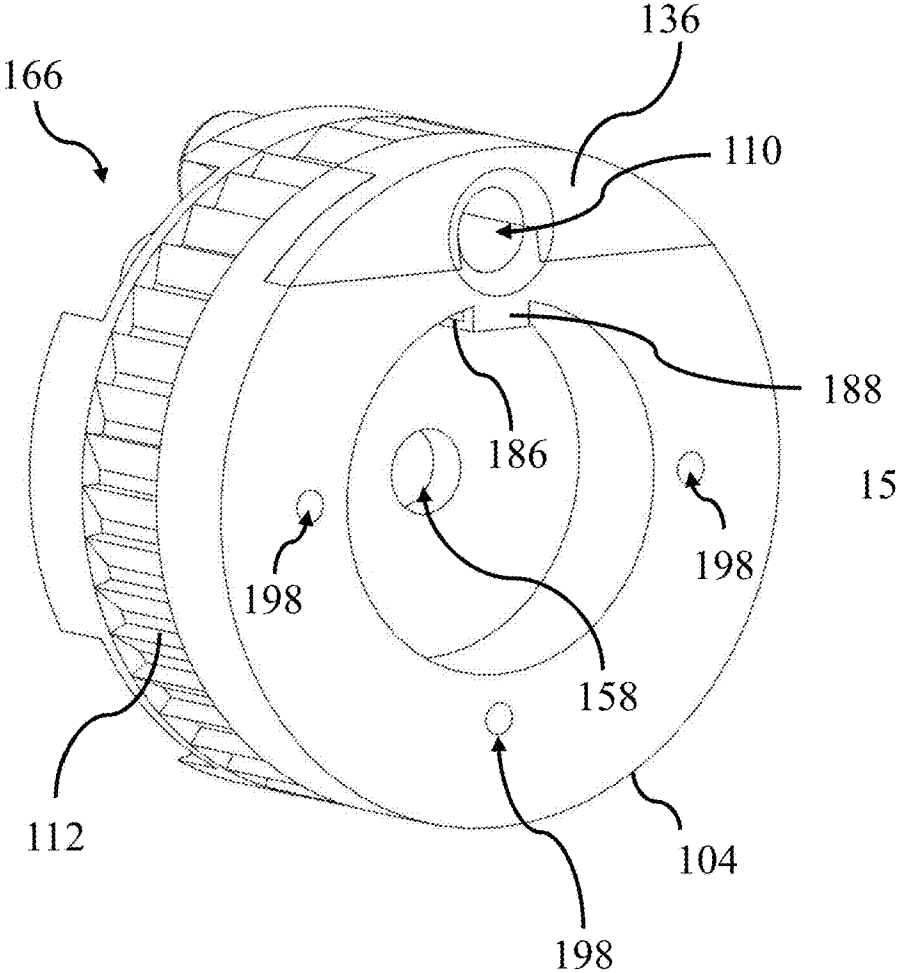
FIG. 6 depicts a front isometric view of the rotary wheel and cable fastener of the cable management system of FIG. 1 shown with all other portions of the cable management system removed.
Figure 9:
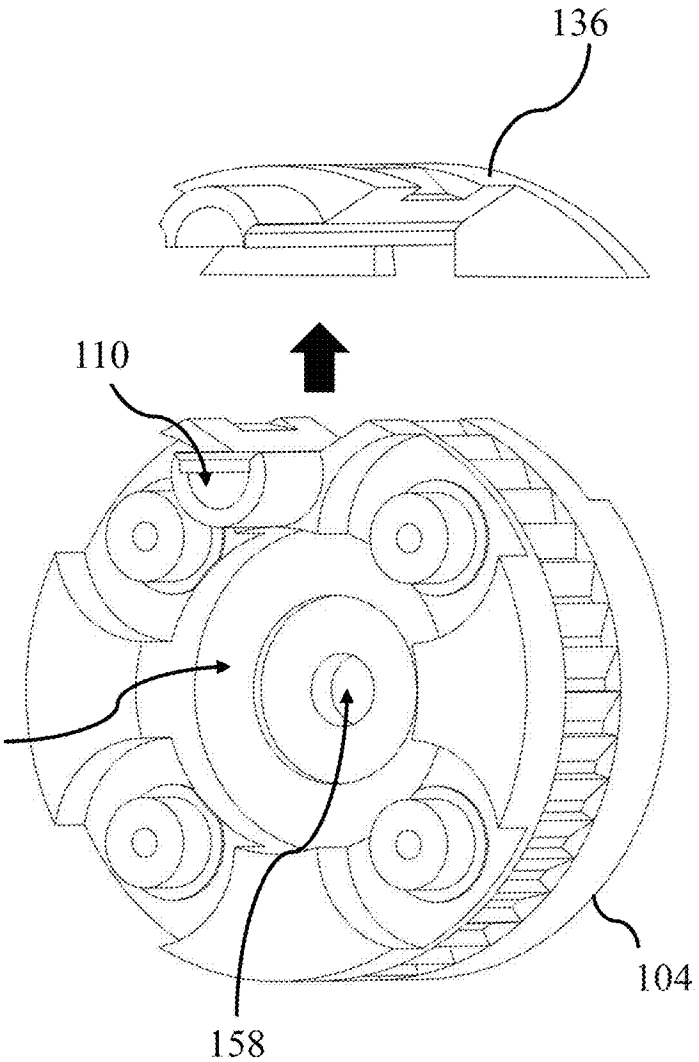
FIG. 9 depicts a rear isometric view of the rotary wheel and cable fastener of FIG. 8.
Figure 8:
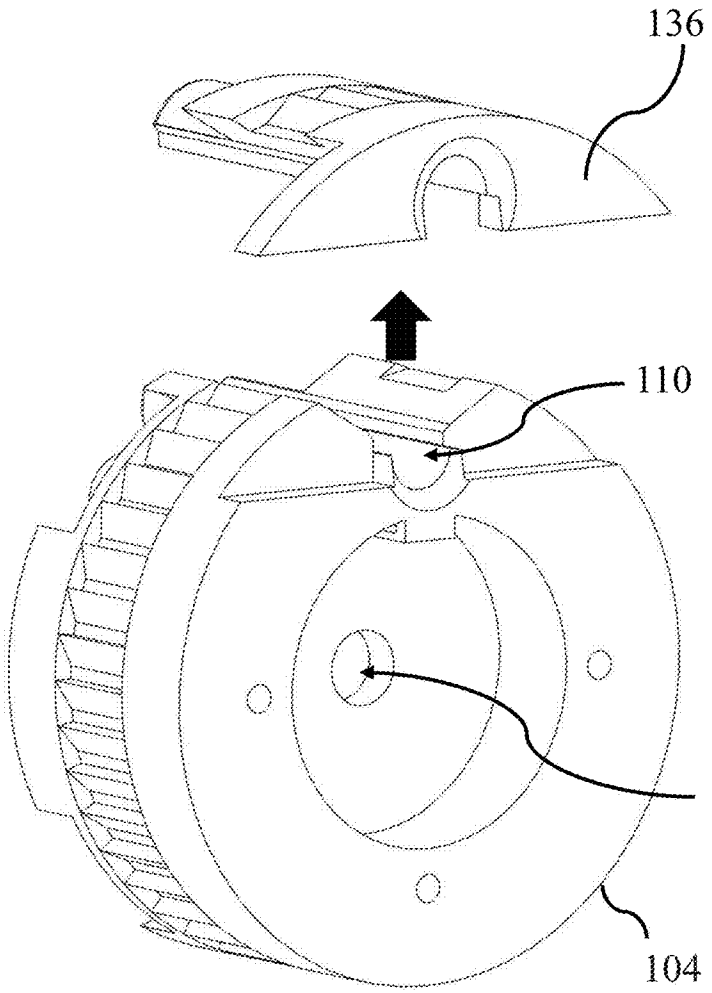
FIG. 8 depicts a front isometric view of the rotary wheel of the cable management system of FIG. 1, shown with the cable fastener separated from the rotary wheel, and shown with all other portions of the cable management system removed.

FIGS. 6-9 show the rotary member (104) along with the cable fastener (136). The bore hole (158) allows the axle (102) to extend through the middle of the rotary member (104). Above the center cavity (160) is a bore opening (110) for the cable to pass through. The cable fastener (136) on top secures the cable within the opening (110) of the rotary member (104). The groove (150) around the center forms a track for the four-bearing set (130, 132, 134, 135). As shown in FIGS. 7 and 9, the rear center cavity (160) accepts the first bearing member (128) so that the rotary member (104) can rotate around the axle (102). The three surrounding compartments (162, 164, 166, 167) accept the four-bearing set (130, 132, 134, 135) which allow the rotary member (104) to rotate within the enclosure (106). As shown in FIGS. 8-9, the cable fastener (136) fits with the top of the rotary member (104). In one example embodiment, one or more fasteners such as screws may couple the cable fastener (136) with the rotary member (104). In other embodiments, the cable fastener (136) and rotary member (104) form one unitary piece. Additionally, as will be described in greater detail below, the rotary member (104) includes a series of cogs or teeth (112) around its exterior which are selectively operable as a locking mechanism or braking system to prevent the rotary member (104) from rotating with respect to the axle (102).

Figure 10:
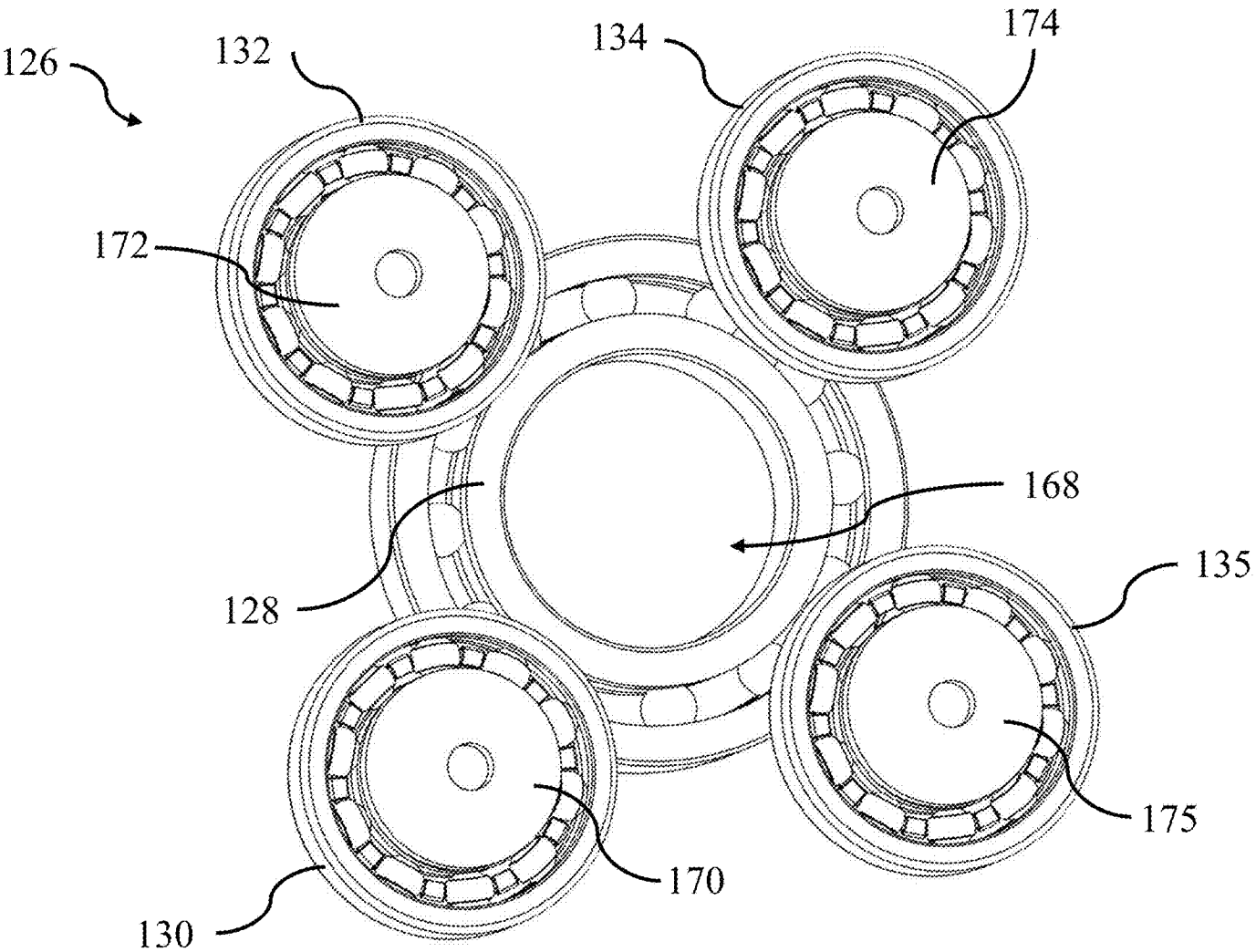
FIG. 10 depicts a rear isometric view of the gear member of the cable management system of FIG. 1.

FIG. 10 shows the gear member (126), which includes the first bearing member (128) and the four-bearing set (130, 132, 134, 135). The first bearing member (128) is arranged near the central opening (168) where the axle (102) extends through. The four-bearing set (130, 132, 134, 135) collectively surround the first bearing member (128). Caps (170, 172, 174, 175) may cover each of the four-bearing set (130, 132, 134, 135), respectively, and couple them with the rotary member (104). The caps (170, 172, 174, 175) may be affixed (e.g., using fasters such as screws) onto each of the four-bearing set (130, 132, 134, 135).

Figure 11:
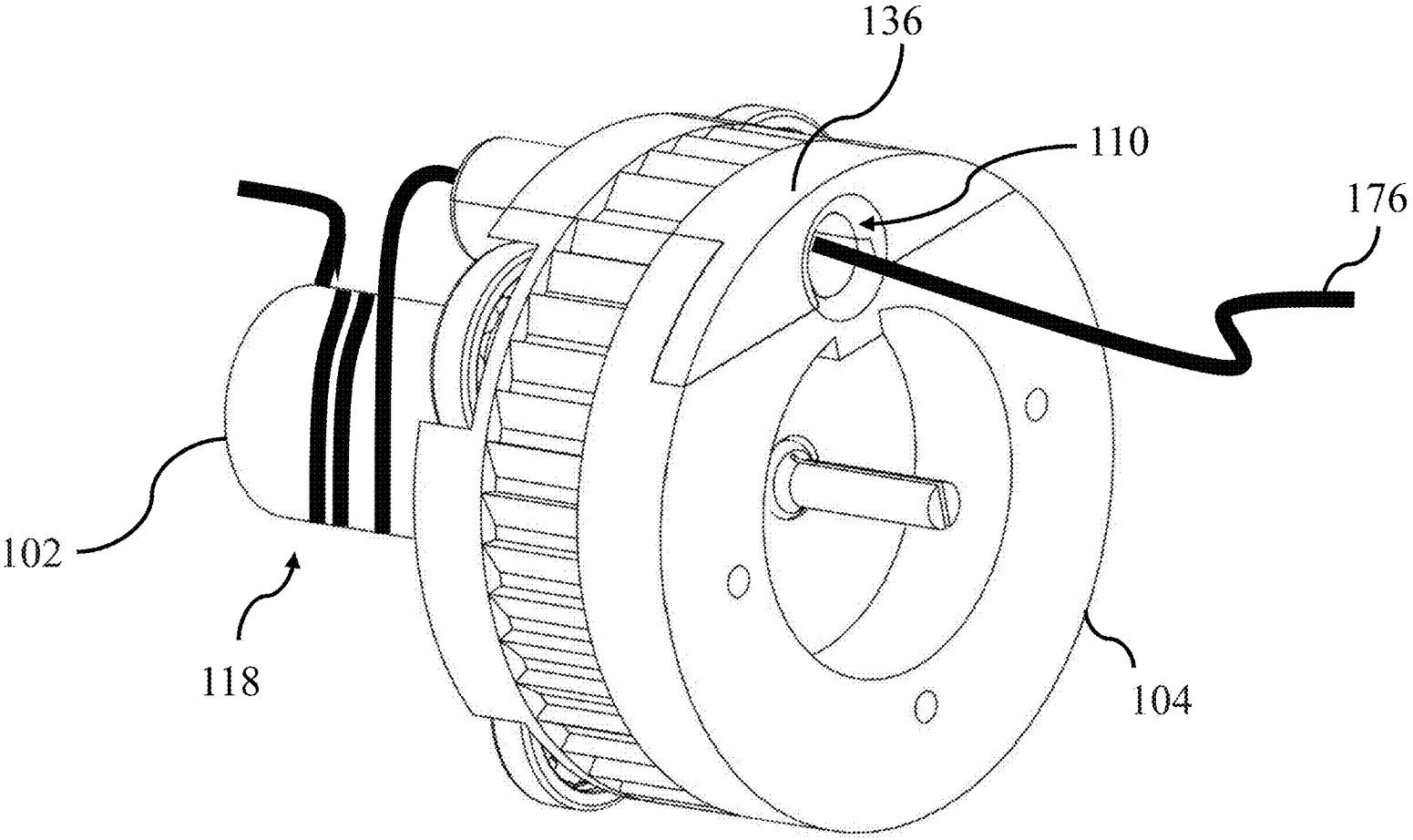
FIG. 11 depicts a front isometric view of the cable management system of FIG. 1, showing the protective enclosure removed, and showing an example cable routed through the cable fastener and wrapped around the axle.
Figure 12:
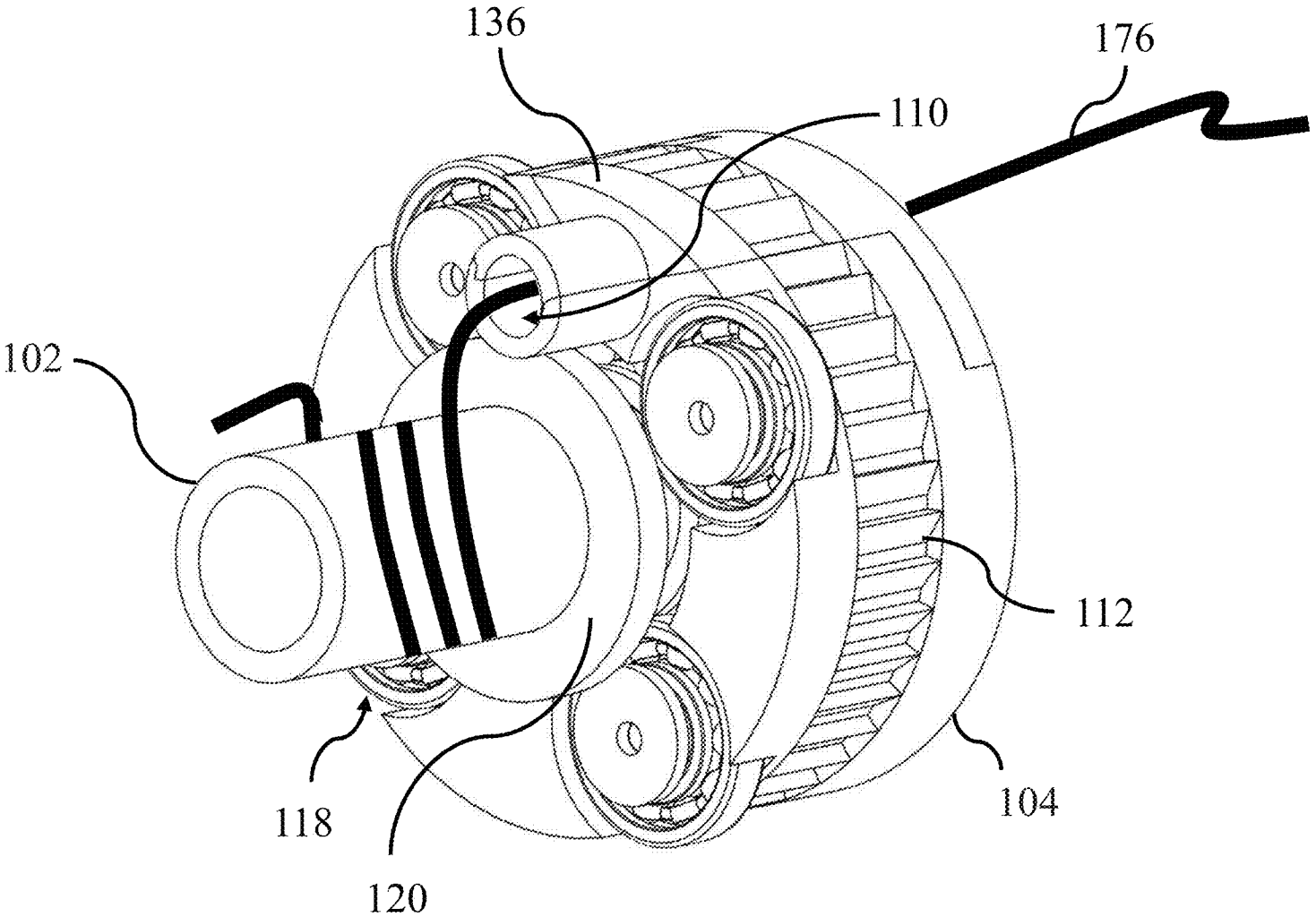
FIG. 12 depicts a rear isometric view of the cable management system of FIG. 1, showing the protective enclosure removed, and showing an example cable routed through the cable fastener and wrapped around the axle.

FIGS. 11-12 show the system (100), with the enclosure (106) removed for clarity, showing a cable (176) routed through the rotary member (104) and wrapped around the axle (102) as described above. Particularly, the hollow portion (118) of the axle (102) stores the wrapped cable, while the rotary member (104) is configured to selectively rotate relative to the axle (102) (e.g., clockwise from the shown perspective). As shown in FIG. 12, the axle tier (120) is configured to stop the cable (176) from wrapping too close to the position where the first bearing member (128) meets the rotary member (104). The four-bearing set (130, 132, 134, 135) and their respective caps (170, 172, 174, 175) are shown. The rotary member (104) will selectively rotate (i.e., counterclockwise from this perspective) and the cable (176) wraps backwards as the rotary member (104) spins.

Figure 13:
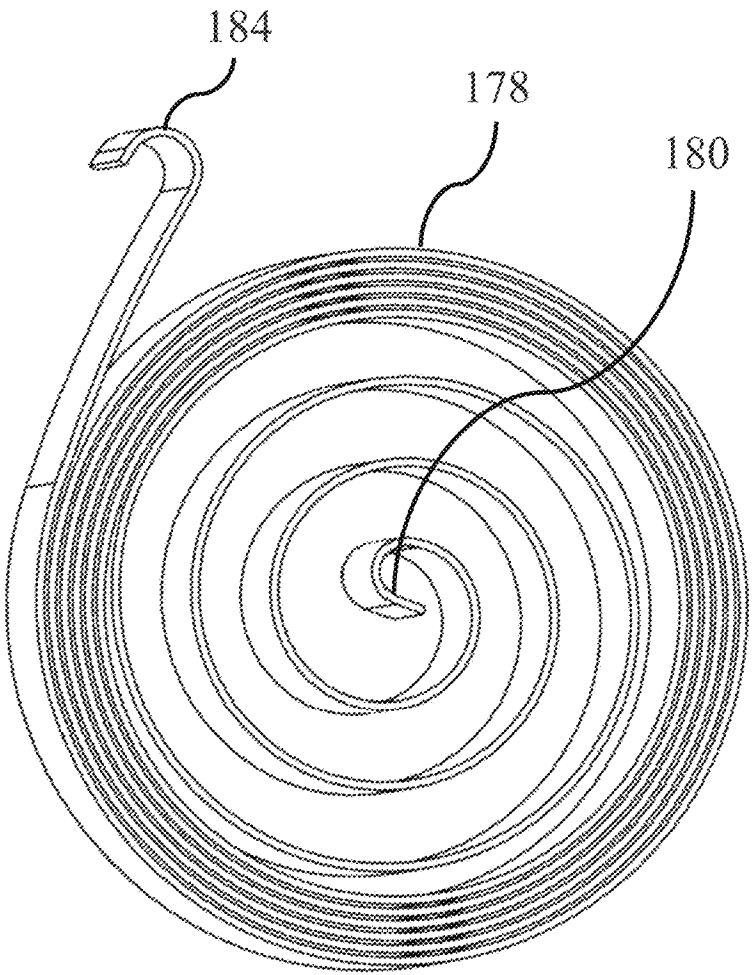
FIG. 13 depicts a front isometric view of the rotor spring of the cable management system of FIG. 1.

FIG. 13 shows the rotor spring (178) which provides the tension to selectively permit extension and retraction of the cable. The rotor spring (178) is coupled with the axle (102) and with the rotary member (104). Specifically, the inner flange (180) of the rotor spring (178) is configured and shaped to couple into the slot (182) of the axle tip (156) (see, FIG. 5), and the outer flange (184) is configured and shaped to couple into the slot (186) of the tongue (188) of the rotary member (104) (see, FIG. 6). As such, the rotary member (104) rotates relative to the axle (102) when a cable is pulled out (i.e., extended), causing tension to build via the rotor spring (178). Once the cable is released (i.e., by a user disengaging the locking mechanism), the rotor spring (178) rotates in the opposite direction to release the tension, consequently spinning the rotary member (104) back to its original position. In one example embodiment, the rotor spring (178) is formed of a stainless-steel material, such as a 1842N1 Rotor Spring manufactured by McMaster-Carr Supply Company of Elmhurst, Illinois.

Figure 14:
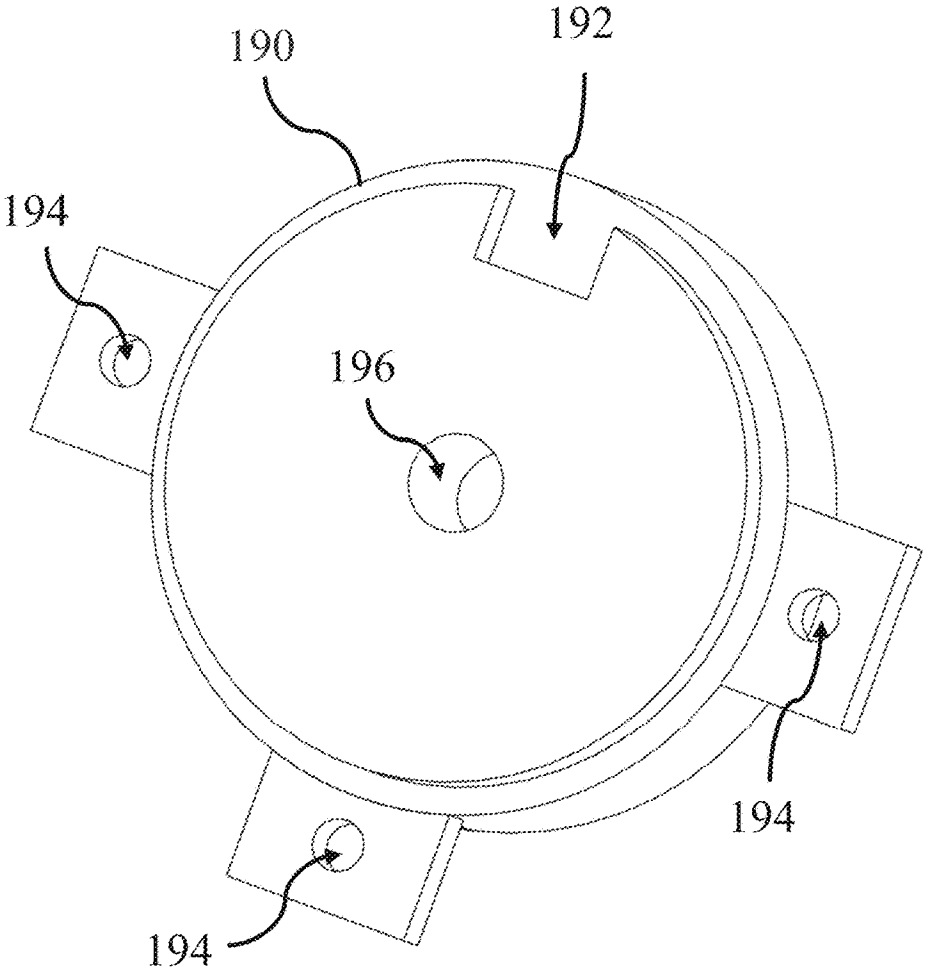
FIG. 14 depicts a front isometric view of the cover for the rotor spring of FIG. 13.

FIG. 14 shows the spring cover (190) which is to be placed onto the front end (116) of the enclosure (106), and specifically over the rotor spring (178) to prevent it from disconnecting from the axle tip (156) during use. The spring cover (190) includes a first recess (192) shaped to fit over the tongue (188) of the rotary member (104). The spring cover (190) further includes one or more holes (194) for affixing the spring cover (190) to the rotary member (104), such as by inserting a fastener (e.g., a screw) (not shown) through the protrusions (194) and into the holes (198) (see, FIG. 6). The spring cover (190) further includes a central recess (196) shaped to fit over the axle tip (156).

Figure 15B:
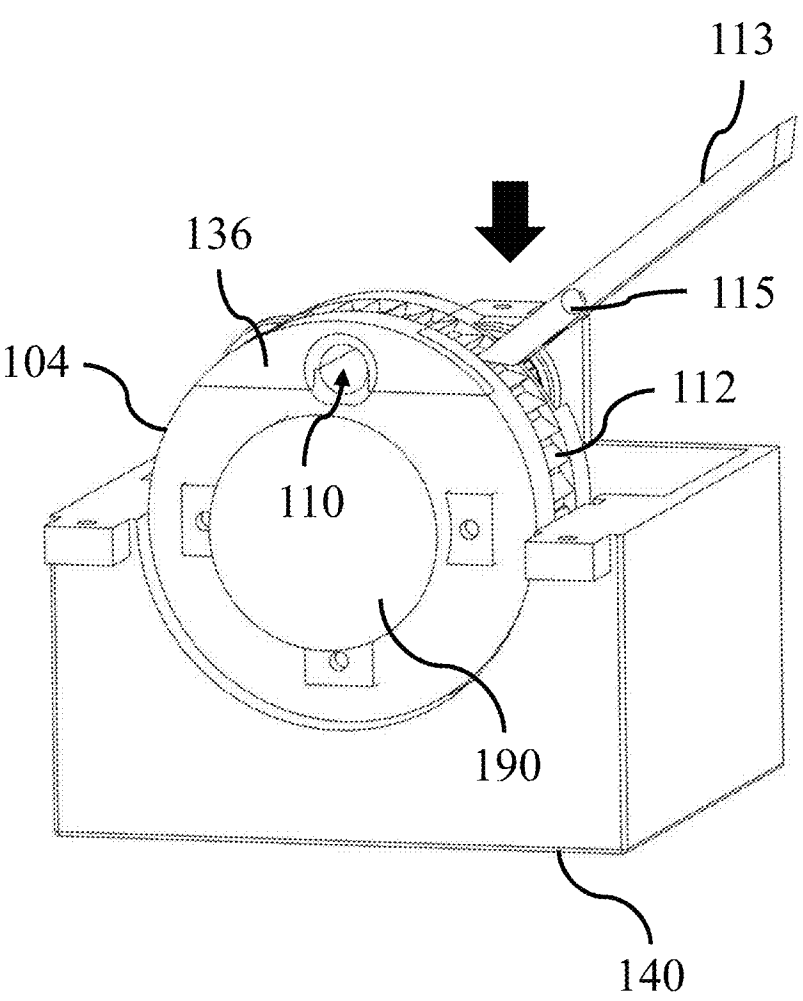
FIG. 15B depicts a front isometric view of the cable management system of FIG. 1, showing the top half of the protective enclosure removed and the locking mechanism in a locked position.
Figure 15A:
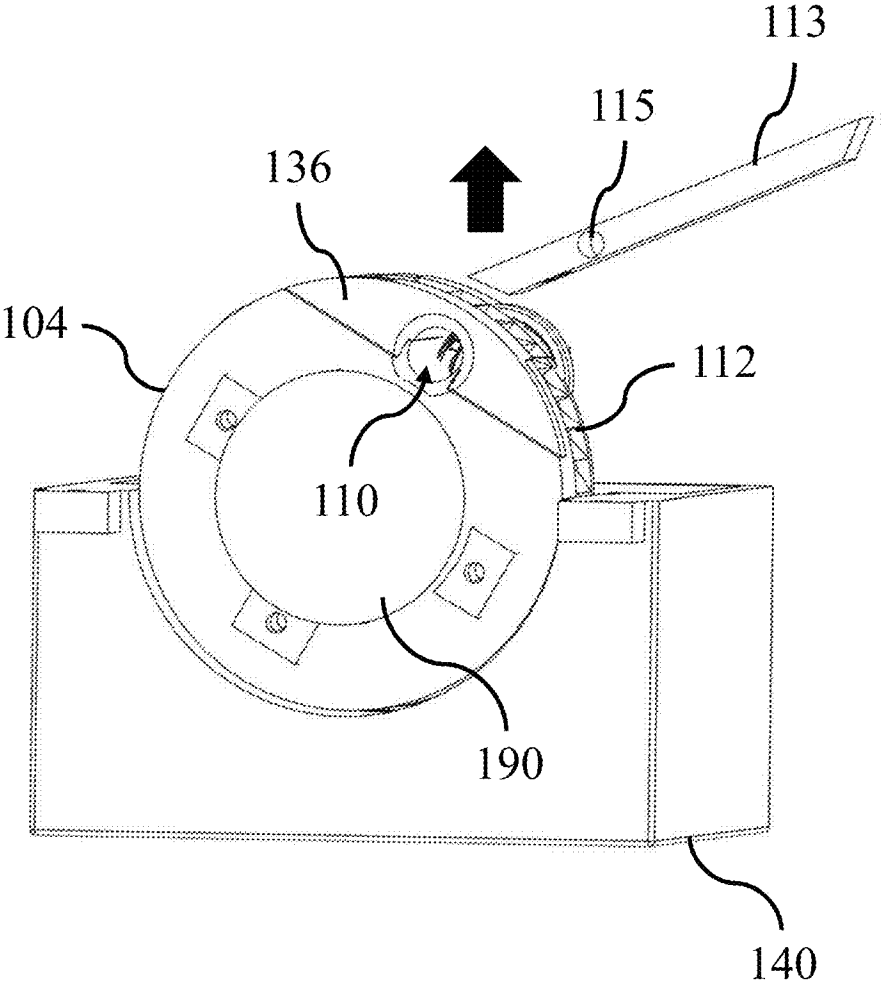
FIG. 15A depicts a front isometric view of the cable management system of FIG. 1, showing the top half of the protective enclosure removed and the locking mechanism in an unlocked position.

FIGS. 15A and 15B show the locking or braking mechanism in greater detail. Particularly, the row of teeth (112) of the rotary member (104) is configured to be contacted by one end of a complementary braking lever (113) (see also, FIG. 1) that is selectively movable (e.g., via hinging at a central pin (115)) by a user to engage one recess defined by the series of teeth (112), therefore allowing a user to selectively engage and disengage a brake to halt or allow the rotation of the rotary member (104). FIG. 15A shows the braking lever (113) pivoted to an unlocked position, whereby the lever (113) is disengaged from the series of teeth (112). FIG. 15B shows the braking lever (113) pivoted to a locked position, whereby the lever (113) is engaged into a recess defined between two teeth of the series of teeth (112). Engaging the lever (113) into the locked position (see, FIG. 15B) prevents the extension or the shortening of the length of exposed cable passing through the opening (110). While the lever (113) is shown extending through a side the enclosure (106), it should be understood that the lever (113) can instead be moved to extend through any other side of the enclosure by re-shaping the lever (113), but without altering the overall functionality of the locking mechanism. In additional embodiments, the lever (113) can be replaced by another form of actuator, such as a push-button, slide-button, or toggle switch.

Figure 16:
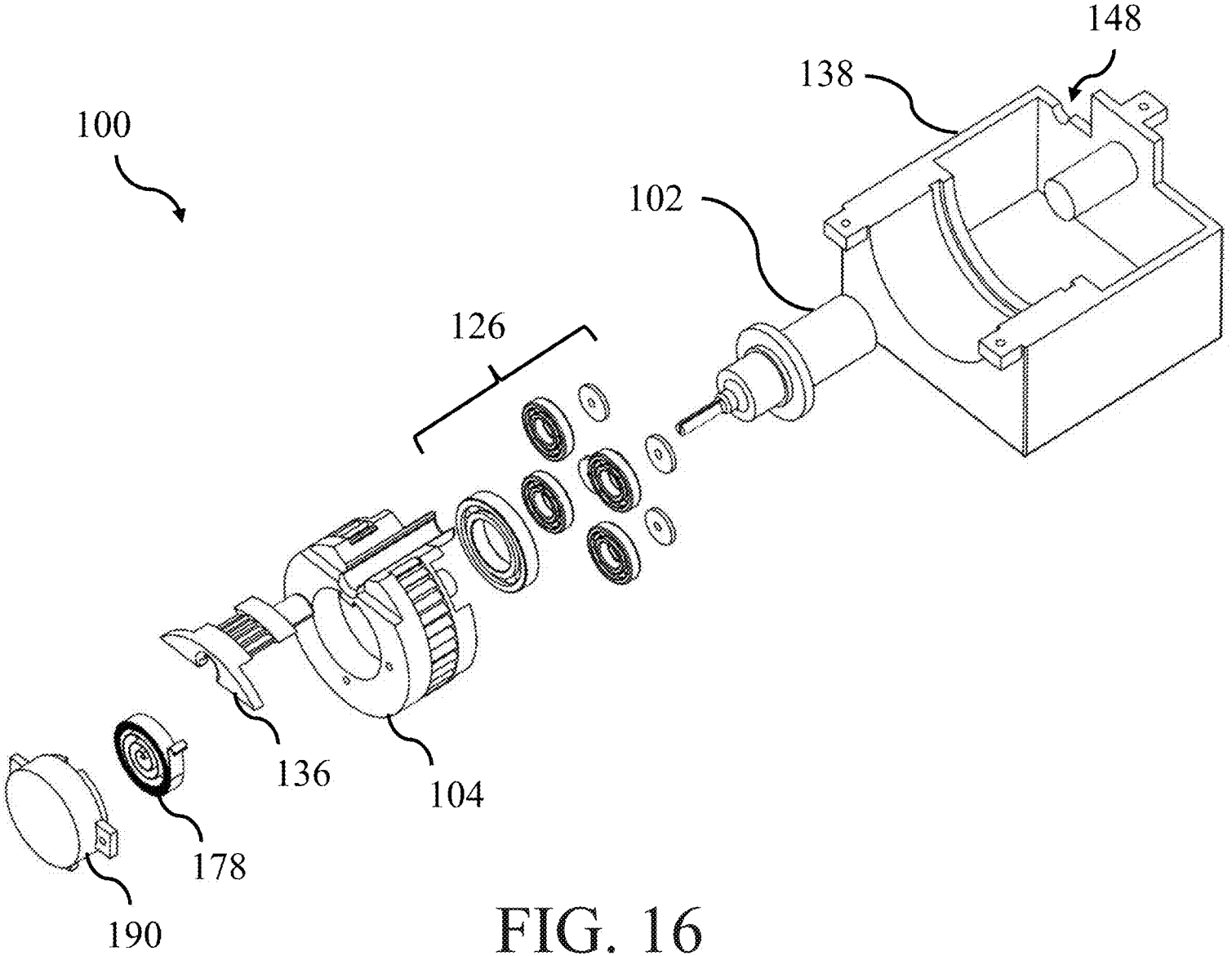
FIG. 16 depicts a front exploded view of the cable management system of FIG. 1, showing the top half of the protective enclosure removed.
Figure 17:
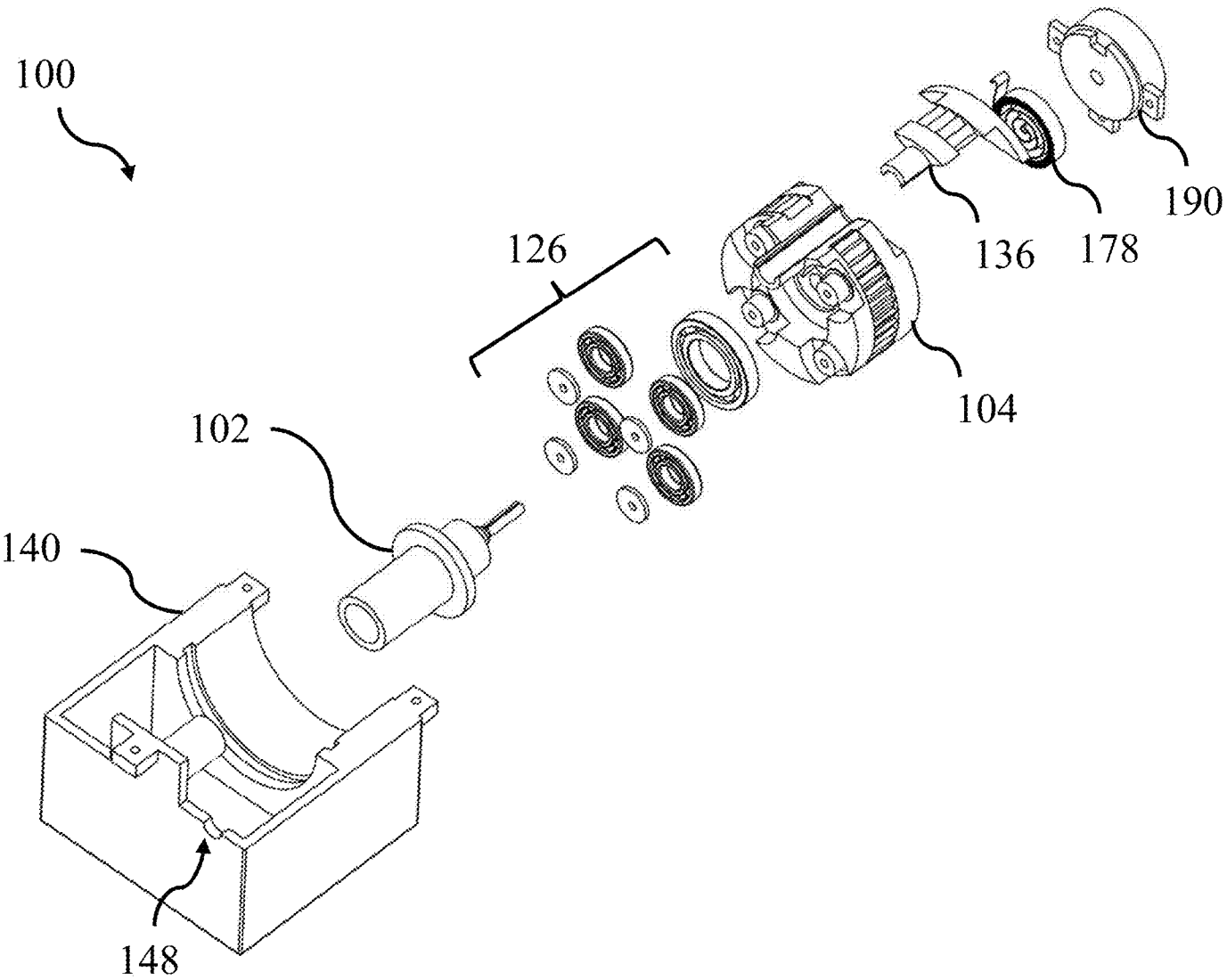
FIG. 17 depicts a rear exploded view of the cable management system of FIG. 1, showing the top half of the protective enclosure removed.
Figure 19:
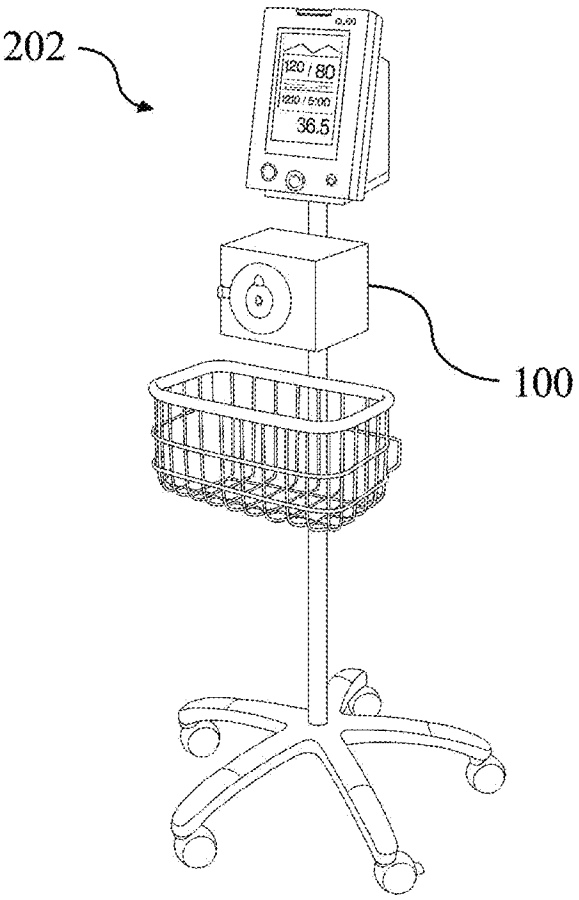
FIG. 19 depicts another example application of the cable management system of FIG. 1, showing the system attached to a second clinical cart.
Figure 18:
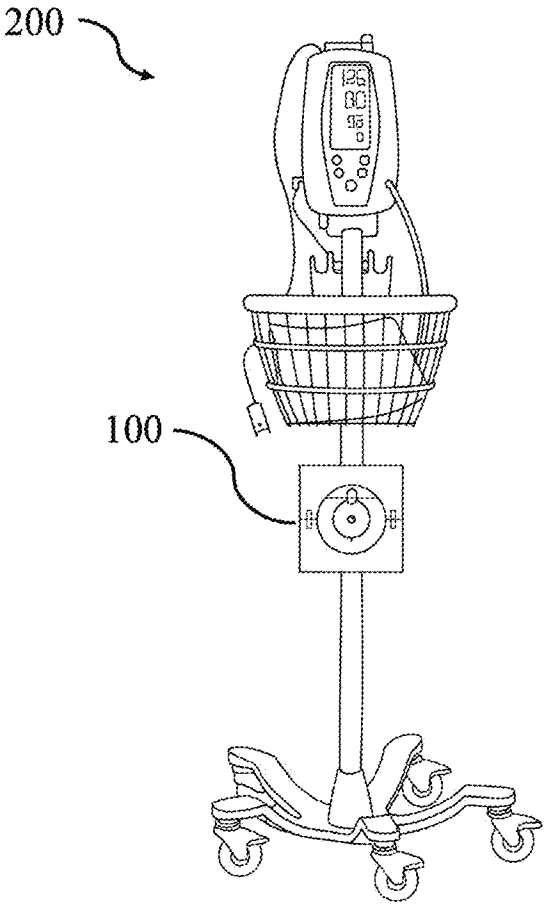
FIG. 18 depicts one example application of the cable management system of FIG. 1, showing the system attached to a first clinical cart.

FIGS. 16-17 show exploded views of the system (100) including each of the components described above. FIG. 18 shows one example of the system (100) coupled with a first clinical cart (200), which commonly holds portable medical devices such as vitals machines. In this example, the system (100) may be coupled with a portion of the cart (200), such as the base of the cart (200), and operable to house one or more cables associated with the medical devices on the cart (200). For instance, a user may provide a medical device onto the cart (200) and insert the power cable into the system (100). Thereafter, the user may selectively extend and retract the cable as needed. Similarly, FIG. 19 shows another example of the system (100) coupled with a second clinical cart (202) at a different position. It should be understood that, while certain medical applications are shown and described, the teachings herein are widely applicable to other types of cables and environments. Additionally, while the system (100) is shown coupled with a vertical pole-like structure, it should also be understood that the system (100) may be adapted to couple with any structure dependent upon the application. Further, the enclosure (106) may also be adapted to include latching mechanisms on any top, bottom, or side surfaces to permit a plurality of systems (100) to be affixed to one another.

Reference systems that may be used herein can refer generally to various directions (for example, upper, lower, forward and rearward), which are merely offered to assist the reader in understanding the various embodiments of the disclosure and are not to be interpreted as limiting. Other reference systems may be used to describe various embodiments, such as those where directions are referenced to the portions of the device, for example, toward or away from a particular element, or in relations to the structure generally (for example, inwardly or outwardly).

While examples, one or more representative embodiments and specific forms of the disclosure have been illustrated and described in detail in the drawings and foregoing description, the same is to be considered as illustrative and not restrictive or limiting. The description of particular features in one embodiment does not imply that those particular features are necessarily limited to that one embodiment. Some or all of the features of one embodiment can be used in combination with some or all of the features of other embodiments as would be understood by one of ordinary skill in the art, whether or not explicitly described as such. One or more exemplary embodiments have been shown and described, and all changes and modifications that come within the spirit of the disclosure are desired to be protected.

We claim:

1. A cable management apparatus, comprising:

(a) a housing having a front face and a rear face and defining an inner cavity, wherein the front face includes a first opening;

(b) an axle positioned within the housing and defining a longitudinal axis;

(c) a rotary member configured to position adjacent to the first opening and defining a bore, wherein the bore is shaped to receive a cable therethrough; and (d) a gear member configured to provide a rotatable coupling between the rotary member, the housing, and the axle, wherein the gear member includes:

i) a first bearing configured to provide a rotatable coupling between the rotary member and the axle, wherein the rotary member is operable to rotate about the longitudinal axis relative to the axle;

ii) a second bearing configured to provide a rotatable coupling between the rotary member and the housing, wherein the rotary member is operable to rotate about the longitudinal axis relative to the housing.

2. The cable management apparatus of claim 1, wherein the rear face of the housing includes a second opening, wherein the second opening is shaped to receive the cable therethrough.

3. The cable management apparatus of claim 1, wherein the first opening of the housing defines a groove, wherein a portion of the rotary member is configured to translate through the groove as the rotary member rotates about the longitudinal axis relative to the housing.

4. The cable management apparatus of claim 1, wherein a rotation of the rotary member about the longitudinal axis relative to the axle is operable to wrap the cable around a portion of the axle.

5. The cable management apparatus of claim 4, wherein the axle includes a flange, wherein the rotation of the rotary member about the longitudinal axis relative to the axle is operable to wrap the cable around the portion of the axle on only one side of the flange.

6. The cable management apparatus of claim 1, wherein the second bearing includes a four-bearing set.

7. The cable management apparatus of claim 6, wherein the rotary member defines a plurality of notches, wherein each bearing of the four-bearing set is shaped to fit within one of the plurality of notches.

8. The cable management apparatus of claim 1, wherein the rotary member is configured to disassemble into two components, wherein each of the two components includes an exterior facing surface forming a portion of the bore.

9. The cable management apparatus of claim 1, comprising a spring operable to selectively wind and unwind the cable around the axle.

10. The cable management apparatus of claim 9, wherein a first end of the spring is configured to couple with the axle, wherein a second end of the spring is configured to couple with the rotary member.

11. The cable management apparatus of claim 1, wherein the housing is configured to disassemble into two components, wherein each of the two components includes an exterior facing surface forming a portion of the first opening.

12. The cable management apparatus of claim 1, wherein:

the axle includes an inner cavity accessible through an open end of the axle;

the housing defines a protrusion within the inner cavity; and the protrusion of the housing is configured to extend into the inner cavity of the axle via the open end.

13. The cable management apparatus of claim 1, wherein an exterior surface of the rotary member includes a gear having a plurality of gear teeth.

14. The cable management apparatus of claim 13, comprising a locking lever extending through a surface of the housing from an exterior position relative to the housing to a position within the inner cavity of the housing adjacent to one or more of the gear teeth of the rotary member, wherein the locking lever is selectively operable to engage and disengage the gear, wherein when the locking lever is engaged to the gear the rotary member is restricted from rotating relative to the axle.

15. An apparatus, comprising:

(a) a housing having a front face and a rear face and defining an inner cavity, wherein the front face includes a first opening;

(b) an axle positioned within the housing and defining a longitudinal axis, wherein the axle includes a distal portion and a proximal portion, wherein the proximal portion is configured to extend through the first opening of the housing;

(c) a rotary member configured to position adjacent to the first opening and defining a first hole and a second hole, wherein the first hole is shaped to receive a cable therethrough and the second hole is shaped to receive the proximal portion of the axle therethrough;

(d) a gear member configured to provide a rotatable coupling between the rotary member, the housing, and the axle, wherein the rotary member is operable to rotate about the longitudinal axis relative to the axle and housing; and (e) a rotor spring having a first end and a second end, wherein the first end is configured to couple with the rotary member and the second end is configured to couple with the axle, wherein a rotation of the rotary member relative to the axle increases or decreases a tension defined by the rotor spring.

16. The apparatus of claim 15, wherein the gear member includes:

a) a first bearing configured to provide a rotatable coupling between the rotary member and the axle, wherein the rotary member is operable to rotate about the longitudinal axis relative to the axle; and b) a second bearing configured to provide a rotatable coupling between the rotary member and the housing, wherein the rotary member is operable to rotate about the longitudinal axis relative to the housing.

17. The apparatus of claim 15, wherein:

the axle includes an inner cavity accessible through an open end of the axle;

the housing defines a protrusion within the inner cavity; and the protrusion of the housing is configured to extend into the inner cavity of the axle via the open end.

18. The apparatus of claim 15, wherein an exterior surface of the rotary member includes a gear having a plurality of gear teeth.

19. The apparatus of claim 18, comprising a locking lever extending through a surface of the housing from an exterior position relative to the housing to a position within the inner cavity of the housing adjacent to one or more of the plurality of gear teeth of the rotary member, wherein the locking lever is selectively operable to engage and disengage the gear, wherein when the locking lever is engaged to the gear the rotary member is restricted from rotating relative to the axle.

20. An apparatus, comprising:

(a) a housing having a front face and a rear face and defining an inner cavity, wherein the front face includes a first opening;

(b) an axle positioned within the housing and defining a longitudinal axis, wherein the axle includes a distal portion and a proximal portion, wherein the proximal portion is configured to extend through the first opening of the housing;

(c) a rotary member configured to position adjacent to the first opening and defining a first hole and a second hole, wherein the first hole is shaped to receive a cable therethrough and the second hole is shaped to receive the proximal portion of the axle therethrough, wherein an exterior surface of the rotary member includes a gear having a plurality of gear teeth;

(d) a gear member configured to provide a rotatable coupling between the rotary member, the housing, and the axle, wherein the rotary member is operable to rotate about the longitudinal axis relative to the axle and housing; and (e) a locking lever extending through a surface of the housing from an exterior position relative to the housing to a position within the inner cavity of the housing adjacent to one or more of the plurality of gear teeth of the rotary member, wherein the locking lever is selectively operable to engage and disengage the gear, wherein when the locking lever is engaged to the gear the rotary member is restricted from rotating relative to the axle.

* * * * *